US006732688B2

(12) United States Patent
Yamamuro et al.

(10) Patent No.: US 6,732,688 B2
(45) Date of Patent: May 11, 2004

(54) VALVE TIMING CONTROL SYSTEM FOR INTERNAL COMBUSTION ENGINE

(75) Inventors: Shigeaki Yamamuro, Kanagawa (JP); Masahiko Watanabe, Yokohama (JP); Naotaka Nakura, Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 10/202,002

(22) Filed: Jul. 25, 2002

(65) Prior Publication Data

US 2003/0029399 A1 Feb. 13, 2003

(30) Foreign Application Priority Data

Aug. 10, 2001 (JP) ..... 2001-243052
Oct. 12, 2001 (JP) ..... 2001-315063

(51) Int. Cl.[7] ..... F01L 1/34
(52) U.S. Cl. ..... 123/90.17; 123/90.15; 123/90.31
(58) Field of Search ..... 123/90.12, 90.15, 123/90.31

(56) References Cited

U.S. PATENT DOCUMENTS 6,502,537 B2 * 1/2003 Todo et al. ..... 123/90.17
6,510,826 B2 * 1/2003 Watanabe ..... 123/90.17
6,561,149 B1 * 5/2003 Kobayashi et al. ..... 123/90.17

FOREIGN PATENT DOCUMENTS

DE 102 03 621 A1 9/2002
JP 2001-41013 2/2001
JP 2001041013 A 2/2001

* cited by examiner

*Primary Examiner*—Thomas Denion
*Assistant Examiner*—Zelalem Eshete
(74) *Attorney, Agent, or Firm*—Foley & Lardner LLP

(57) ABSTRACT

A valve timing control system includes a driving plate, a lever provided to a camshaft, a radial slot formed in the driving plate, an intermediate rotator arranged rotatable with respect to the driving plate and the camshaft and having a spiral slot, and a link having a base end pivotally coupled to the lever and a front end arranged swingably and including a ball engaged with the spiral slot and a block member engaged with the radial slot. The ball has a center of engagement located on a swinging axis of the front end of the link, producing no moment.

11 Claims, 15 Drawing Sheets

VALVE TIMING CONTROL SYSTEM FOR INTERNAL COMBUSTION ENGINE

BACKGROUD OF THE INVENTION

The present invention relates to a valve timing control system for an internal combustion engine, which performs variable control of opening and closing timing of an intake or exhaust engine valve in accordance with the engine operating conditions.

Typically, the valve timing control system controls opening and closing timing of an engine valve by controlling the phase of rotation of a crankshaft and a camshaft on a power transfer path from the crankshaft to the camshaft. Specifically, the system comprises a driving rotator coupled to the crankshaft through a timing chain and the like, a follower rotator coupled to the camshaft and to which the driving rotator is mounted to enable relative rotation as required, and a mounting-angle control mechanism interposed between the two rotators to control a mounting angle formed therebetween. Operating-force providing means provide an operating force to the mounting-angle control mechanism when required to change the phase of rotation of the crankshaft and the camshaft.

Various types of mounting-angle control mechanisms have been developed, one of which uses a helical gear to convert rectilinear operation of a hydraulic piston to rotary operation of the driving and follower rotators. Recently, a mounting-angle control mechanism using a link is proposed which has many advantages such as shortened axial length and less friction loss.

However, as will be described in detail hereinafter, the valve timing control system including a link as mounting-angle control mechanism raises a problem of occurrence of vibration and noise. Additionally, the system presents problems of an increase in the number of parts and thus a cost rise, a decrease in design flexibility of various system portions due to increased size and weight, and a unstableness of valve timing control during high-speed operation.

SUMMARY OF THE INVENTION

It is, therefore, an object of the present invention to provide a valve timing control system for an internal combustion engine, which contributes to achievement of smooth and quiet operation as well as a reduction in the number of parts and thus cost lowering and in system size and weight, an increase in design flexibility, and a stabilization of valve timing control.

The present invention provides generally a system for controlling a valve timing in an internal combustion engine, which comprises: a driving rotator rotated by a crankshaft of the engine; a follower rotator provided to a camshaft of the engine, the follower rotator receiving power from the driving rotator; a radial guide provided to one of the driving rotator and the follower rotator; an intermediate rotator arranged rotatable with respect to the driving rotator and the follower rotator, the intermediate rotator comprising a spiral guide in a face opposite to the radial guide; a link having a base end pivotally coupled to another of the driving rotator and the follower rotator at a position distant from a center of rotation thereof and a front end arranged swingably and comprising a first engagement engaged with the spiral guide and a second engagement engaged with the radial guide; and a device which provides to the intermediate rotator an operating force for rotation with respect to the driving rotator and the follower rotator, the device making radial displacement of the front end of the link along the radial guide with the first engagement engaged with the spiral guide, the radial displacement being converted into relative rotation of the driving rotator and the follower rotator through the link, wherein the first engagement has a center of engagement located on a swinging axis of the front end of the link.

BRIEF DESCRIPTION OF THE DRAWINGS

The other objects and features of the present invention will become apparent from the following description with reference to the accompanying drawings, wherein.

DETAILED DESCRIPTION OF THE INVENTON

Before entering a description about the preferred embodiments of the present invention, a valve timing control system disclosed in JP-A 2001-41013 is described.

Figure 8:
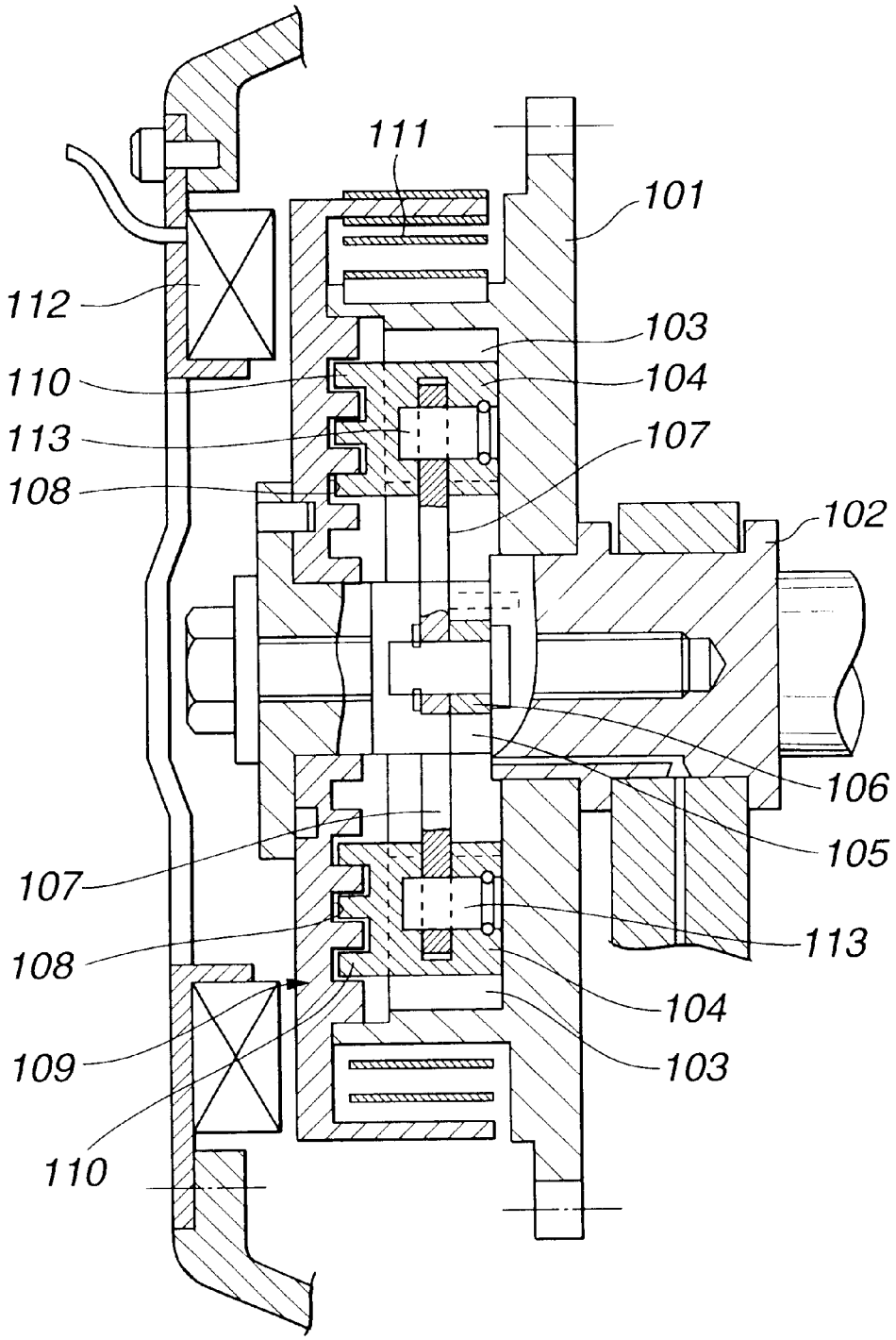
FIG.8 (RELATED ART)
FIG. 8 is a view similar to FIG. 5, showing a valve timing control system in the related art.
Figure 9:
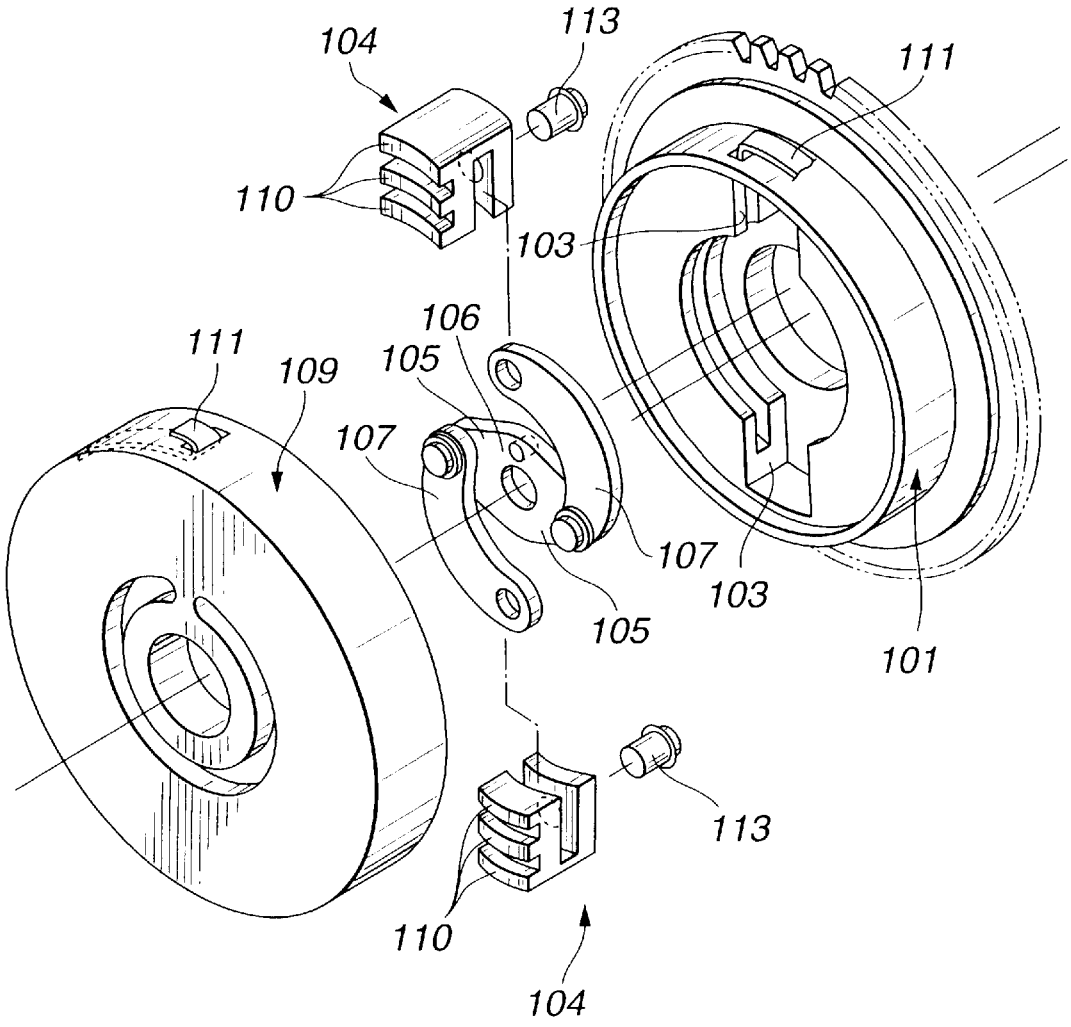
FIG.9 (RELATED ART)
FIG. 9 is an exploded perspective view showing the valve timing control system in the related art.

Referring to FIGS. 8–9, the system comprises a housing or driving rotator 101 coupled to a crankshaft through a timing chain, a camshaft or follower rotator 102 having an end to which housing 101 is rotatably mounted, a plurality of movable blocks 104 with roughly rectangular section radially slidably engaged with guide slots or radial guides 103 formed in the inner end face of housing 101, a lever shaft 105 mounted to the end of camshaft 102 and having levers 106 protruding radially outward, wherein movable block 104 is pivotally connected to corresponding lever 106 of lever shaft 105 through a link 107. An intermediate rotator 109 having a spiral slot or guide 108 in the side face opposite to radial guide 103 is mounted to housing 101 at the position facing radial guide 103 so as to be rotatable with respect to housing 101 and camshaft 102. A plurality of roughly circular protrusions or engagements 110 protruding from one axial end of each movable block 104 is engaged with spiral guide 108. Intermediate rotator 109 is biased by a power spring 111 in the rotation advancing direction with respect to housing 101, and is subjected to a force out of an electromagnetic brake 112 in the rotation delaying direction. A pivot pin 113 serves to rotatably connect movable block 104 to a front end or head of link 107.

With this system, when electromagnetic brake 112 is turned off, intermediate rotator 109 is located in the initial position with respect to housing 101 under a biasing force of power spring 111, wherein movable block 104 engaged with spiral guide 108 of intermediate rotator 109 through protrusions 110 performs maximum radially outward displacement to raise link 107, maintaining a mounting angle formed between housing 101 and camshaft 102 at the maximum lag angle or the maximum advance angle. In this state, when electromagnetic brake 112 is turned on, intermediate rotator 109 is reduced in speed to perform rotation in the lag direction with respect to housing 101. As a result, movable block 104 engaged with spiral guide 108 performs radially inward displacement to gradually lower link 107 raised so far, changing the mounting angle of housing 101 and camshaft 102 to the maximum lag angle or the maximum advance angle.

With this system, however, protrusions 110 of movable block 104 are formed roughly circularly, so that the center of engagement of movable block 104 with respect to spiral guide 108 is located offset from an axis of pivot pin 113 which functions as a swinging shaft of link 107 at the head thereof. As a result, when movable block 104 is radially operated under a force out of intermediate rotator 109 upon changing valve timing, or it receives a reaction force from an engine valve through link 107, etc., a moment with the center of engagement of pivot pin 113 or protrusions 110 as center acts on movable block 104. This moment inhibits smooth operation of the head of link 107 or movable block 104, causing occurrence of vibration and noise.

Moreover, with this system, movable block 104 engaged with radial guide 103 and spiral guide 108 includes a member which is separate and distinct from link 107 and is connected to the head thereof through pivot pin 113, leading to an increase in the number of parts and thus a cost rise. Additionally, movable block 104 should be provided with a site for holding pivot pin 113, causing an increase in size and weight thereof, resulting in a decrease in design flexibility of various system portions due to easy interference between the head of link 107 and other parts and in a unstableness of valve timing control during high-speed operation due to increased inertia mass of the head of link 107.

Referring next to FIGS. 1–4, a first embodiment of the present invention is described, wherein the present invention is applied to a power transfer system on the intake side of the engine. Note that the present invention can be applied to a power transfer system on the exhaust side of the engine.

Figure 1:
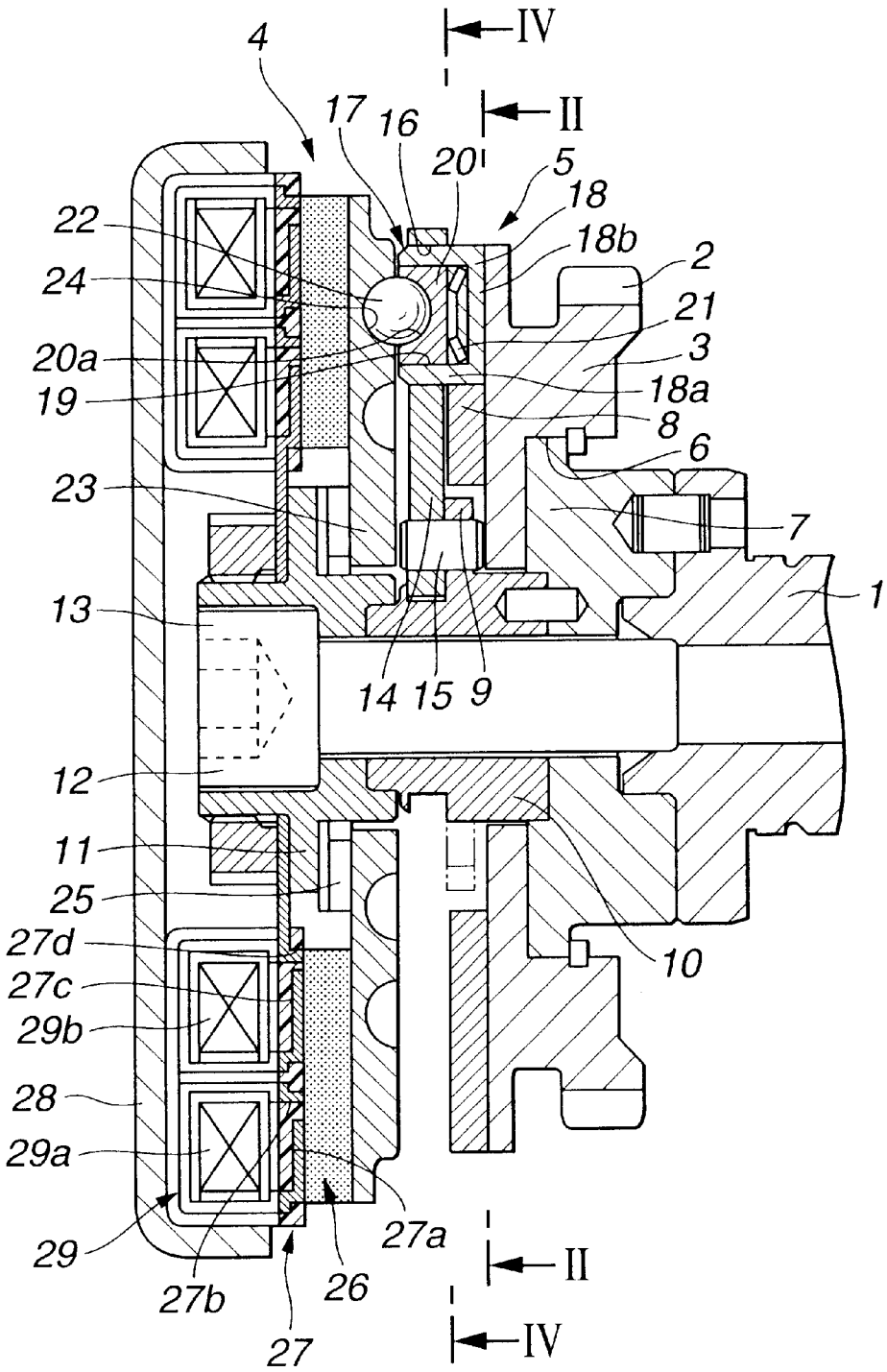
FIG. 1 is a longitudinal section showing a first embodiment of a valve timing control system for an internal combustion engine according to the present invention.

Referring to FIG. 1, the valve timing control system comprises a camshaft 1 rotatably supported to a cylinder head, not shown, of an internal combustion engine, a driving plate or driving rotator 3 mounted to camshaft 1 at the front end to enable relative rotation as required and including at the outer periphery a timing sprocket 2 rotated together with a crankshaft, not shown, a mounting-angle control mechanism 5 disposed in front of camshaft 1 and driving plate 3, i.e. on the left as viewed in FIG. 1, to control a mounting angle formed between the two 1, 3, and operating-force providing means 4 disposed in front of mounting-angle control mechanism 5 for operating mechanism 5.

Figure 2:
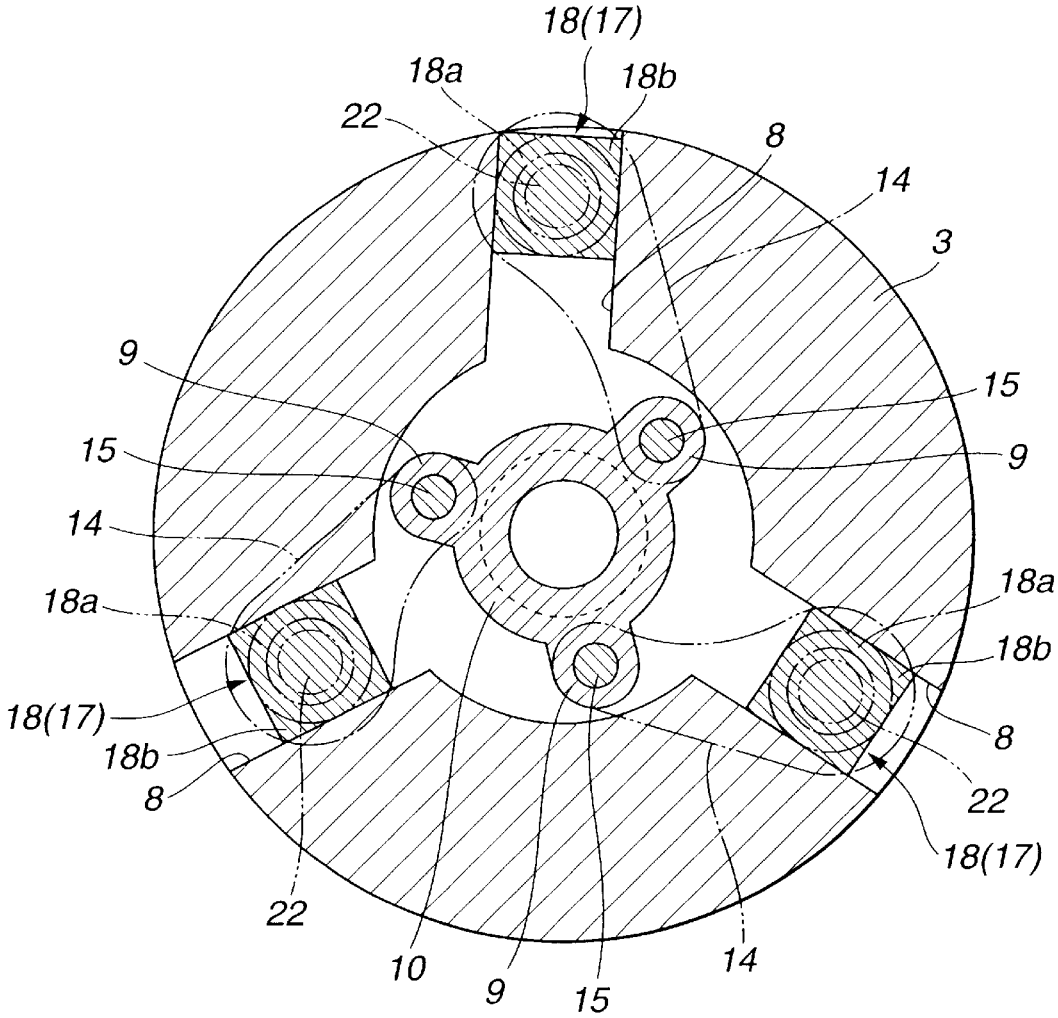
FIG. 2 is a sectional view taken along the line II—II in FIG. 1.

Driving plate 3 is formed like a disc having at the center a stepped support hole 6, which is rotatably supported by a flange ring 7 integrally connected to a front end of camshaft 1. Referring to FIG. 2, three radial slots or guides 8 with roughly C-shaped section are formed in the front face (the far side with respect to camshaft 1) of driving plate 3 along substantially the radial direction thereof.

A lever shaft 10 having radially protruding three levers 9 and a holding ring 12 having a support flange 11 are arranged on the front side of flange ring 7 in the superimposed state, and are connected, together with flange ring 7, to camshaft 1 by a bolt 13. A link 14 has one end rotatably supported to lever 9 of lever shaft 10 through a pin 15, and another end formed with an axially extending holding hole 16 in which an engagement unit 18 comprising the following components is accommodated. In this embodiment, a follower rotator comprises flange ring 7, lever shaft 10, and holding ring 12.

Figure 3:
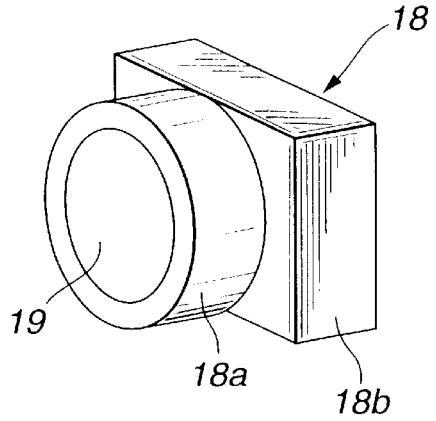
FIG. 3 is a perspective view showing a block member.

Referring to FIG. 3, engagement unit 17 comprises a block member 18 including a cylindrical shank 18*a* slidably fit in holding hole 16 of link 14 and a rectangular-prism-like base or second engagement 18*b* slidably engaged with radial slot 8 of driving plate 3. Block member 18 is formed with an accommodation hole 19 extending from the head face of shank 18*a* to the inside of base 18*b*. Accommodated in hole 19 are a retainer 20 having at the head face a semispherical recess 20*a* and a disc spring or biasing means 21 for biasing retainer 20 forward. A ball or first engagement 22 is held in recess 20*a* of retainer 20 in a free rolling way, and is engaged in a free rolling way with a spiral slot or guide 24 with circular section of an intermediate rotator 23 as will be described later.

With engagement unit 17, block member 18 has base 18*b* radially guided by radial slot 8 of driving plate 3, and shank 18*b* rotatably held in holding hole 16 of link 14 to function as a swinging shaft of link 14 at the head thereof. Thus, when ball 22 undergoes an external force with radial constituents from intermediate rotator 23, engagement unit 17 is displaced along radial slot 8 while allowing swing of the head of link 14. At that time, therefore, link action of link 14 and lever 9 causes relative rotation of driving plate 3 and camshaft 1 in the direction and by an angle corresponding to displacement of block member 18.

A base end of link 14 is pin-supported in the state superimposed on the front side of lever 9 and without holding lever 9 between its front and rear portions, wherein lever 9 is disposed in a space radially interior of radial slot 8 of driving plate 3. Therefore, in this embodiment, a distance between driving plate 3 and intermediate rotator 23 can sufficiently be reduced without causing interference between lever 9 and the side edge of radial slot 8, achieving shortened axial overall length of the system.

Figure 4:
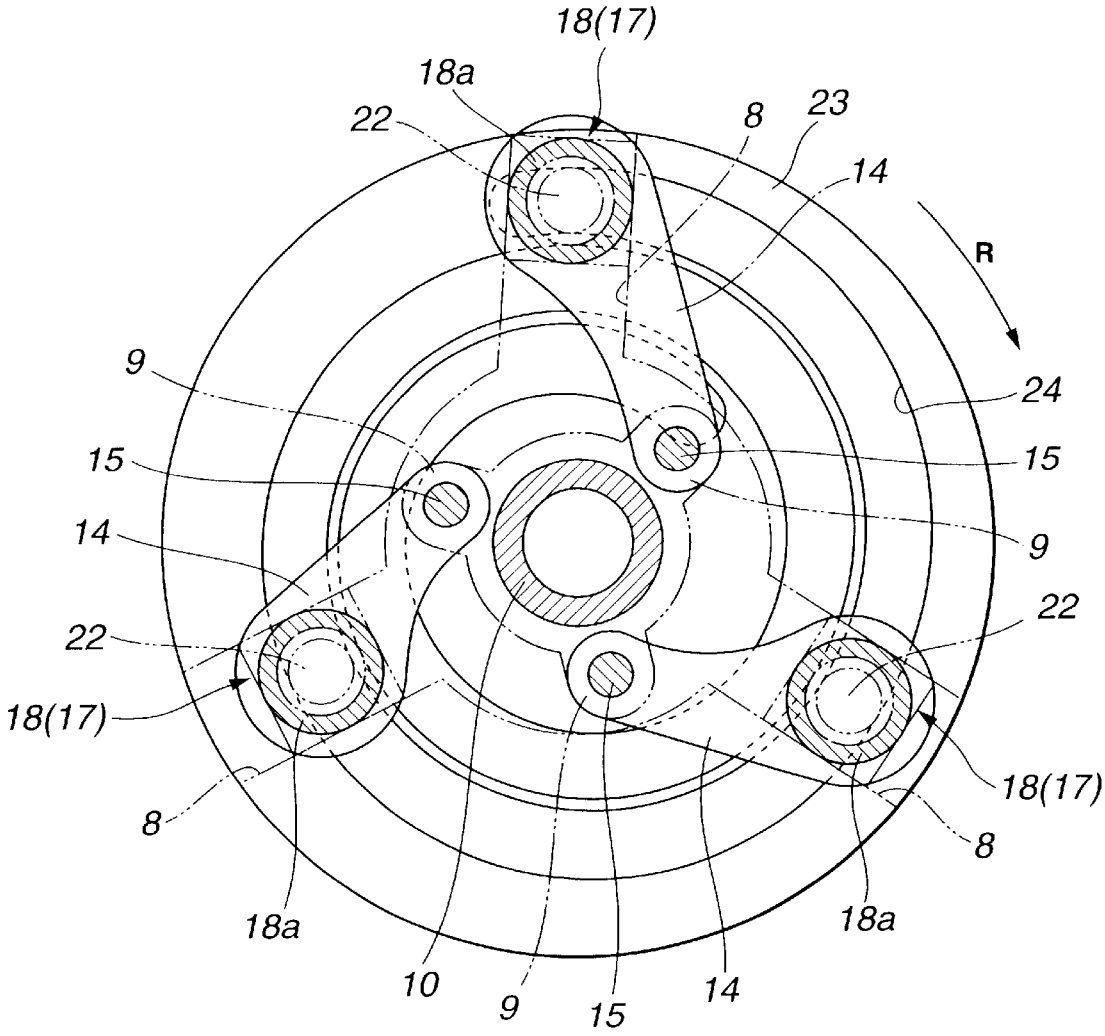
FIG. 4 is a view similar to FIG. 2, taken along the line IV—IV in FIG. 1.

Roughly disc-like intermediate rotator 23 is supported on the rear side of support flange 11 of holding ring 12 through a needle bearing 25, and has a rear or driving-plate-side face formed with spiral slot 24. Referring to FIG. 4, spiral slot 24 includes a single slot with which balls 22 of three engagement units 17 are engaged. A spiral of spiral slot 24 is gradually reduced in diameter along a direction of rotation R of driving plate 3. Therefore, with ball 22 of engagement unit 17 engaged with spiral slot 24, when intermediate rotator 23 performs relative rotation in the lag direction with respect to driving plate 3, engagement unit 17 is moved radially inward along the spiral of spiral slot 24, whereas when intermediate rotator 23 performs relative rotation in the advance direction, engagement unit 17 is moved radially outward.

Operating-force providing means 4 comprise a permanent-magnet block 26 joined to the outer peripheral edge of the front face of intermediate rotator 23, a yoke block 27 mounted to holding ring 12 in such as way as to overhang radially outward as a flange, and an electromagnetic-coil block 26 arranged in a valve timing control (VTC) cover 28 attached to the cylinder head and a rocker cover, not shown. A pattern of energizing a plurality of coils 29*a*, 29*b* of electromagnetic-coil block 26 is changed in sequence in accordance with pulse input, thus obtaining relative rotation of permanent-magnet block 26 and yoke block 27 as appropriate.

Permanent-magnet block 26 comprises a plurality of magnetic or N and S poles alternately disposed along the circumferential direction to radially extend from the surface perpendicular to the axial direction. Yoke block 27 comprises two pairs of pole-teeth yokes 27*a*, 27*b*; 27*c*, 27*d*, each yoke including a plurality of pole teeth extending from its annular base. Electromagnetic-coil block 29 comprises two coils 29*a*, 29*b* corresponding to the respective pairs of pole-teeth yokes 27*a*, 27*b*; 27*c*, 27*d*. Magnetic entrances for coils 29*a*, 29*b* of electromagnetic-coil block 29 face the annular bases of pole-teeth yoke 27*a*, 27*b*; 27*c*, 27*d* through an air gap, respectively. The magnetic field produced by coils 29*a*, 29*b* is changed in predetermined patterns by pulse input, thus moving the magnetic poles which occur in the pole teeth of yoke block 27 along the circumferential direction. And the attraction and repulsion between the magnetic poles of yoke block 27 and those of permanent-magnet block 26 causes relative rotation of yoke block 27 and permanent-magnet block 26. This magnetic force acts as an operating force to intermediate rotator 23. Note that relative rotation of yoke block 27 and permanent-magnet block 26 is switched to the opposite direction by reversing the patterns of changing the magnetic field produced by electromagnetic-coil block 29.

In this embodiment, the valve timing control system is constructed as described above, so that upon engine start and during idle running, keeping in advance the mounting angle of driving plate 3 and lever shaft 10 on the maximum lag-angle side allows the phase of rotation of the crankshaft and camshaft 1, i.e. opening and closing timing of the engine valve, to be on the maximum lag-angle side, achieving stabilized engine rotation and improved fuel consumption.

From this state, when engine operation proceeds normal running, and an electronic control unit (ECU), not shown, provides a command to the drive circuit of electromagnetic-coil block 29 so as to change the phase of rotation to the maximum advance-angle side, electromagnetic-coil block 29 switches a produced magnetic field in predetermined patterns in accordance with the command, making maximum relative rotation of permanent-magnet block 26 together with intermediate rotator 23 in the advance direction. Thus, engagement unit 17 engaged with spiral slot 24 by ball 22 performs maximum radially outward displacement along radial slot 8, changing the mounting angle of driving plate 3 and lever shaft 10 through link 14 and lever 9 to the maximum advance-angle side. As a result, the phase of rotation of the crankshaft and camshaft 1 is changed to the maximum advance-angle side, achieving a power increase of the engine.

On the other hand, from this state, the ECU provides a command to change the phase of rotation to the maximum lag-angle side, electromagnetic-coil block 29 switches a produced magnetic field in reversed patterns to make maximum relative rotation of intermediate rotator 23 in the lag direction, performing maximum radially outward displacement of engagement unit 17 engaged with spiral slot 24 along radial slot 8. Thus, engagement unit 17 performs relative rotation of driving plate 3 and lever shaft 10 through link 14 and lever 9 to change the phase of rotation of the crankshaft and camshaft 1 to the maximum lag-angle side.

When intermediate rotator 23 is rotated under a force out of operating-force providing means 4, ball 22 of engagement unit 17 is guided by spiral slot 24 of intermediate rotator 23 while rolling. At that time, ball 22 is disposed coaxial with shank 18*a* of block member 18 which functions as a swinging shaft of link 14 at the head thereof, i.e. on the axis of the swinging shaft, a moment does not act on a portion between the engagement of spiral slot 24 and ball 22 and the head of link 14. Therefore, in this embodiment, there is no occurrence of backlash at the head of link 14 (corresponding to engagement unit 17) due to that moment upon changing valve timing, obtaining always smooth operation of link 14.

Moreover, not only upon changing valve timing, but at other time during operation of the engine, torque variation resulting from the characteristic of a spring of the engine valve and the profile of a driving cam is input to lever shaft 10. At that time as well, a moment does not act on a portion between the engagement of spiral slot 24 and ball 22 and the head of link 14, producing no backlash at the head of link 14 due to that moment. Therefore, in this embodiment, vibration and noise due to torque variation in camshaft 1 can surely be prevented from occurring.

In this embodiment, disc spring 21 accommodated in block member 18 of engagement unit 17 biases ball 22 toward spiral slot 24, and base 18*b* of block member 18 toward radial slot 8, resulting in surer prevention of occurrence of backlash at the head of link 14. In place of disc spring, biasing means 21 may be a coil spring, a rubber elastic body or fluid pressure such as hydraulic or pneumatic pressure.

Moreover, in this embodiment, the head of link 14 is engaged with spiral slot 24 through ball 22, having small slide resistance with spiral slot 24, resulting in smooth and lossless conversion of torque of intermediate rotator 23 into operation of link 14. No occurrence of power loss due to sliding allows a reduction in size and weight of operating-force providing means 4, resulting in a reduction in size and weight of the overall system.

Further, in this embodiment, block member 18 is rotatably mounted to the head of link 14, and its base 18*b* extending to driving plate 3 is slidably engaged with radial slot 8, allowing simplified and miniaturized constitution of the portion or second engagement engaged and guided by radial slot 8, leading to a reduction in manufacturing cost and in size and weight of the overall system. Moreover, in this embodiment, retainer 20 is accommodated in shank 18*a* of block member 18 to hold ball 22 in the center of retainer 20, reducing a radial space which ball or first engagement 22 and base 18*b* of block member 18 or second engagement occupy, leading also to a reduction in size and weight of the overall system. Without considering the occupation space, second engagement 18*b* engaged with radial slot 8 can be disposed as a separate and distinct block at a position offset from the swinging axis on which first engagement 22 is disposed.

Still further, in this embodiment, base 18*b* of block member 18 is formed like a rectangular prism, two flat side faces of which are bought into slide contact with side faces of radial slot 8, reducing the surface pressure of the slide contact face between block member 18 and radial slot 8, resulting in enhanced wear resistance. Base 18*b* of block member 18 may be formed cylindrically, which allows a reduction in slide resistance between block member 18 and radial slot 8. In this variation, rotation of block member 18 is allowed in radial slot 8, enabling integral formation of block member 18 with the head of link 14.

Furthermore, in this embodiment, engagement unit 17 arranged at the head of link 14 is engaged with a single spiral slot 24 of intermediate rotator 23. Thus, lessening of the inclination or pitch of the spiral of spiral slot 24 allows a reduction in diameter of intermediate rotator 23, and a decrease in tangential constituents of a load input to engagement unit 17 from intermediate rotator 23 during operation, achieving smaller backlash at the head of link 14.

Figure 5:
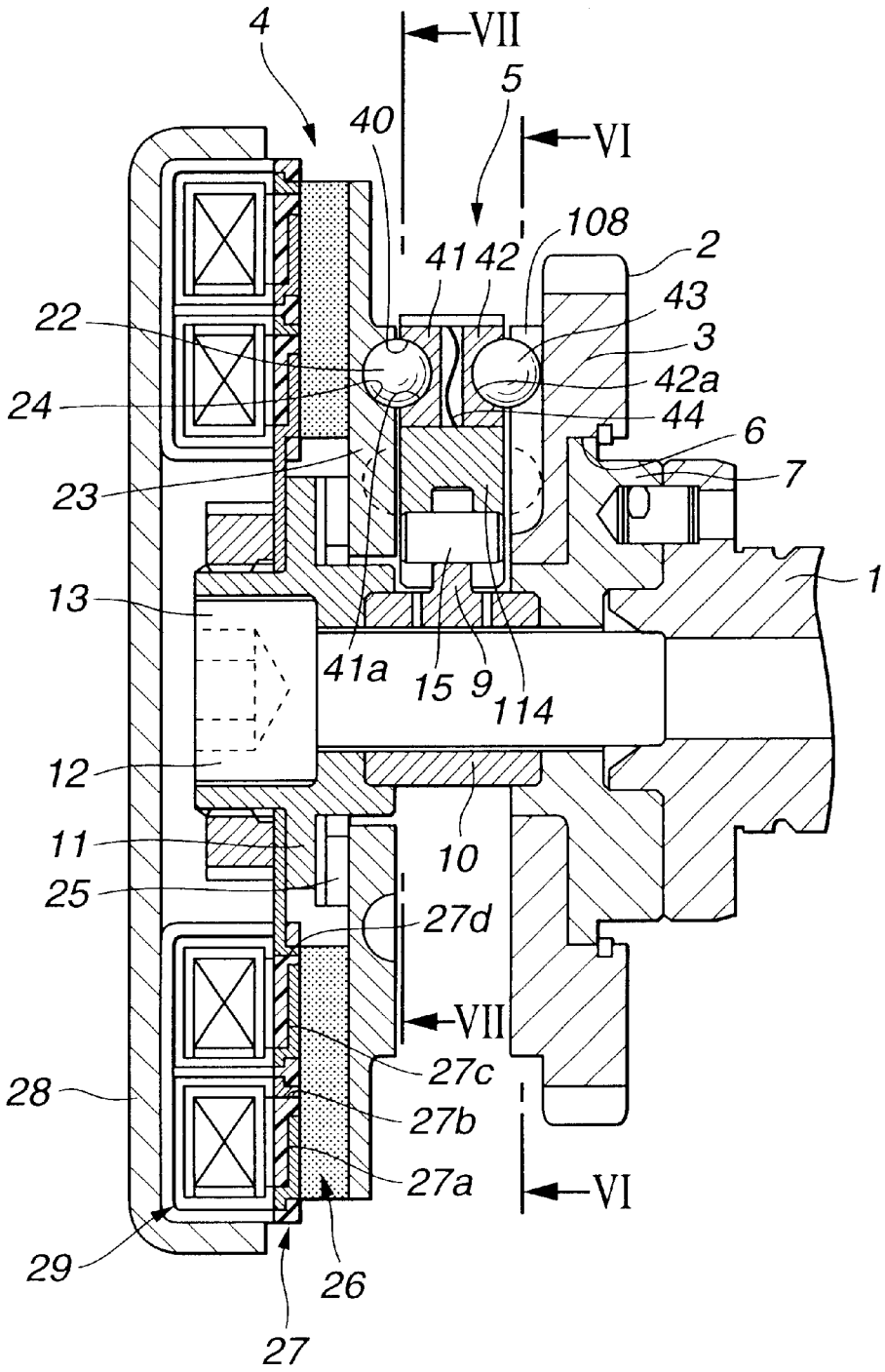
FIG. 5 is a view similar to FIG. 1, showing a second embodiment of the present invention.
Figure 6:
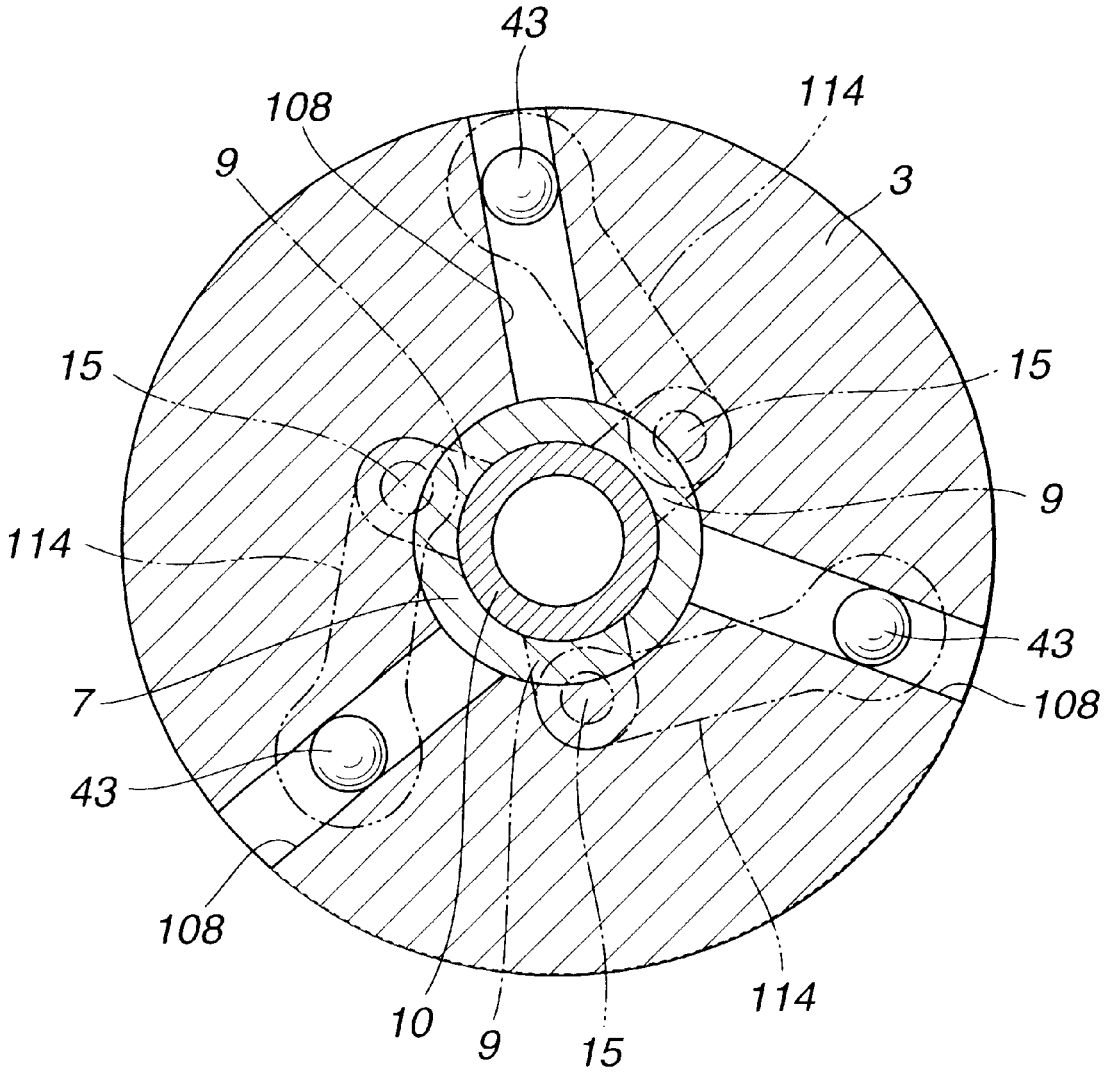
FIG. 6 is a view similar to FIG. 4, taken along the line VI—VI in FIG. 5.
Figure 7:
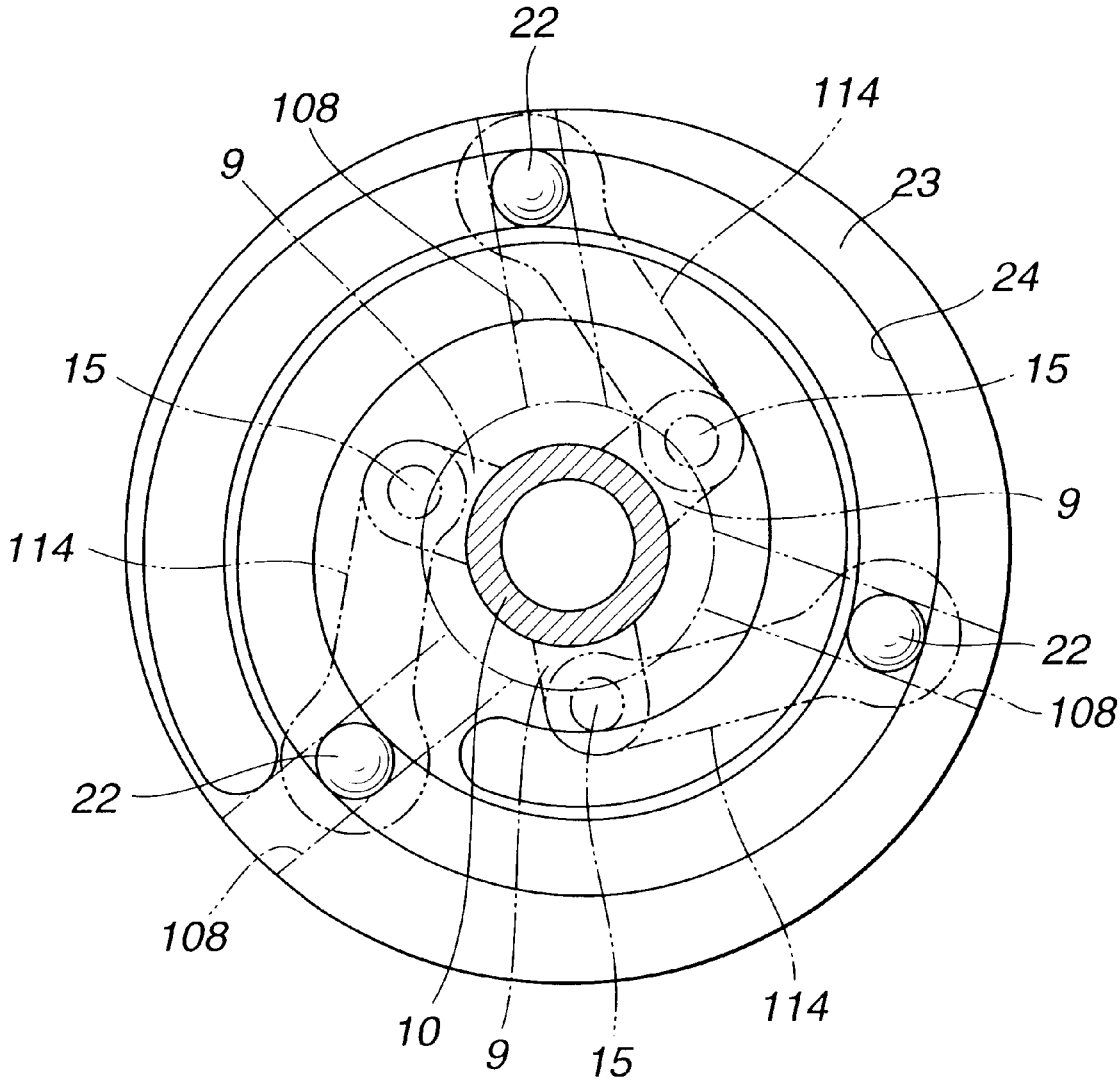
FIG. 7 is a view similar to FIG. 6, taken along the line VII—VII in FIG. 5.

Referring to FIGS. 5–7, a second embodiment of the present invention is described, wherein like reference numerals in FIGS. 1–4 and 5–7 designate like parts. The second embodiment is substantially the same as the first embodiment in the fundamental constitution of mounting-angle control mechanism 5 arranged between driving plate 3 and camshaft 1 and operating-force providing means 4 for operating mounting-angle control mechanism 5, but differs therefrom in the specific constitution of an engagement of a link 114 constituting mounting-angle control mechanism 5 with driving plate 3 and intermediate rotator 23.

Specifically, referring to FIG. 5, a holding hole 40 is formed in the head of link 114 to extend axially, and first and second retainers 41, 42 are slidably accommodated therein. A plate spring or biasing means 44 is interposed between first and second retainers 41, 42 to bias them in the opposite directions. First and second retainers 41, 42 have semi-spherical recesses 41*a*, 42*a* formed in the center of the outside faces, respectively. Ball or first engagement 22 and ball or second engagement 43 are held in respective recesses 41*a*, 42*a* in a free rolling way. Balls 22, 43 are engaged with spiral slot 24 of intermediate rotator 23 and radial slot 108 of driving plate 3 in a free rolling way, wherein radial slot 108 has a semicircular section like spiral slot 24.

Balls 22, 43 and first and second retainers 41, 42 function as a swinging shaft allowing swing of the head of link 114. Therefore, in this embodiment as well, ball or first engagement 22 is disposed on the swinging axis of the head of link 114.

Operation of the second embodiment is essentially the same as that of the first embodiment. Since ball or first engagement 22 is disposed on the swinging axis of the head of link 114, a moment does not occur between the engagement of spiral slot 24 and ball 22 and the head of link 114 to produce backlash. In the second embodiment, as distinct from the first embodiment, the second engagement engaged with radial slot 108 includes ball 43, allowing a further reduction in slide resistance at radial slot 108. This leads to a further reduction in operating force demanded of operating-force providing means 4, achieving reduced size of operating-force providing means 4, resulting in further reduction in size and weight of the overall system.

Moreover, in this embodiment, ball or first engagement 22 and ball or second engagement 43 are coaxially disposed through retainers 41, 42, respectively, allowing further reduction in a radial space which the front and rear engagements occupy, and prevention of occurrence of a moment between the head of link 114 and radial slot 108. This leads to surer prevention of occurrence of backlash of the head of link 114. Without considering the occupation space, ball 43 or second engagement engaged with radial slot 8 can be disposed as a separate and distinct block at a position offset from the swinging axis on which the first engagement 22 is disposed.

Further, in this embodiment, plate spring or biasing means 44 always brings front and rear balls 22, 43 into close and sure contact with spiral slot 24 and radial slot 108. This biasing action also contributes to prevention of backlash of the head of link 114.

In the first and second embodiments, the driving rotator includes driving plate 3 having timing sprocket 2. Optionally, the driving rotator may include a timing pulley to which rotation is transferred through a belt, and a gear directly meshed with a gear of other shaft. Moreover, operating-force providing means 4 are not limited to the construction that relative rotation of yoke block 27 and permanent-magnet block 26 is performed by switching a produced magnetic field in predetermined patterns, but may be the construction that rotation of intermediate rotator 23 is increased and decreased by the action of a braking force or electromagnetic force or directly by a motor unit.

Referring to FIGS. 10–15, a third embodiment of the present invention is described.

Figure 10:
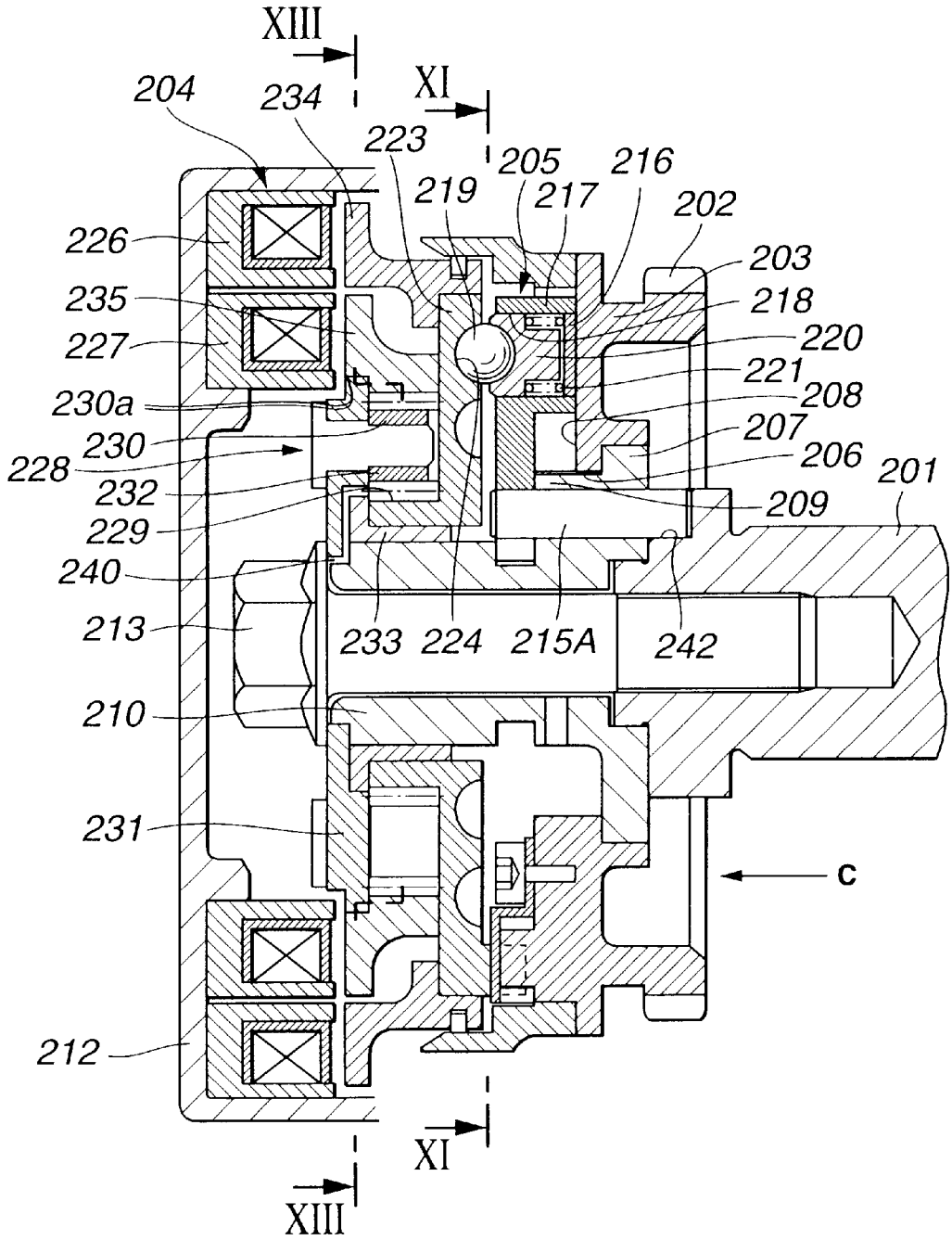
FIG. 10 is a view similar to FIG. 8, showing a third embodiment of the present invention.

Referring to FIG. 10, the valve timing control system comprises a camshaft 201 rotatably supported to a cylinder head, not shown, of an internal combustion engine, a driving plate or driving rotator 203 mounted to camshaft 201 at the front end to enable relative rotation as required and including at the outer periphery a timing sprocket 202 coupled to a crankshaft, not shown, through a chain, not shown, a mounting-angle control mechanism 205 disposed in front of camshaft 201 and driving plate 203, i.e. on the left as viewed in FIG. 10, to control a mounting angle formed between the two 201, 203, operating-force providing means 204 disposed in front of mounting-angle control mechanism 205 for operating mechanism 205, a VTC cover 212 attached to the front face of the cylinder head and a rocker cover, not shown, to conceal the front face of operating-force providing means 204 and mounting-angle control mechanism 205 and their neighborhood.

Figure 11:
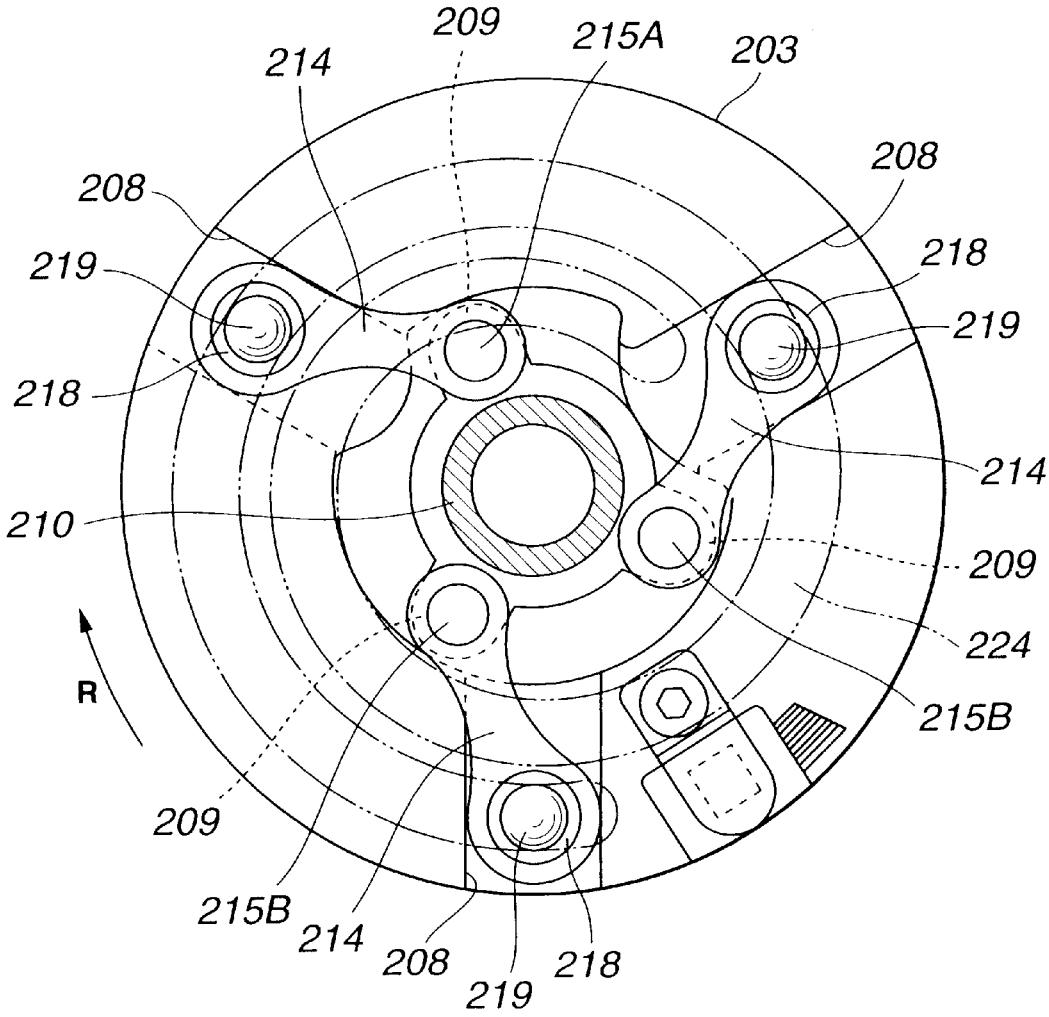
FIG. 11 is a view similar to FIG. 7, taken along the line XI—XI in FIG. 10.

Driving plate 203 is formed like a disc having a through hole 206, in which a lever shaft or follower rotator 210 integrally connected to a front end of camshaft 201 is rotatably fit. Referring to FIG. 11, three radial slots or guides 208 each comprising a pair of facing parallel side walls are formed in the front face (the far side with respect to camshaft 201) of driving plate 203 along the radial direction of plate 203.

As shown in FIG. 10, lever shaft 210 includes a large-diameter flange 207 formed at the outer periphery of the base abutting on the front end of camshaft 201, and three levers 209 radially protruding from the outside face in front of large-diameter flange 207. Lever shaft 210 is coupled to camshaft 201 by a bolt 213 arranged axially. A link 214 has a base end pivotally connected to levers 209 of lever shaft 210 by a pivot pin 215A, 215B, and a front end or head integrally formed with a cylindrical protrusion 217 slidably engaged with radial slot 208.

With protrusion 217 engaged with corresponding radial slot 208, link 214 is coupled to lever shaft 210 through pivot pin 215A, 215B. Thus, when the head of link 214 is displaced along radial slot 208 under an external force, driving plate 203 and lever shaft 210 perform relative rotation in the direction and by an angle corresponding to the displacement of protrusion 217 under the action of link 214.

A through hole 218 is formed at the head of link 214 to axially extend from a link main body to protrusion 217. A plate sealing member 216 which is separate and distinct from link 214 is press fit in through hole 218 at the end on the side of protrusion 217. Accommodated in through hole 218 are a ball 219 engaged with a spiral slot or guide 224 as will be described later, a roughly cylindrical retainer 220 for supporting the back of ball 219, and a coil spring or biasing member 221 interposed between retainer 220 and sealing member 216 and for biasing ball 219 forward. In this embodiment, a movable guide comprises protrusion 217 at the head of link 214 and ball 219.

Figure 14:
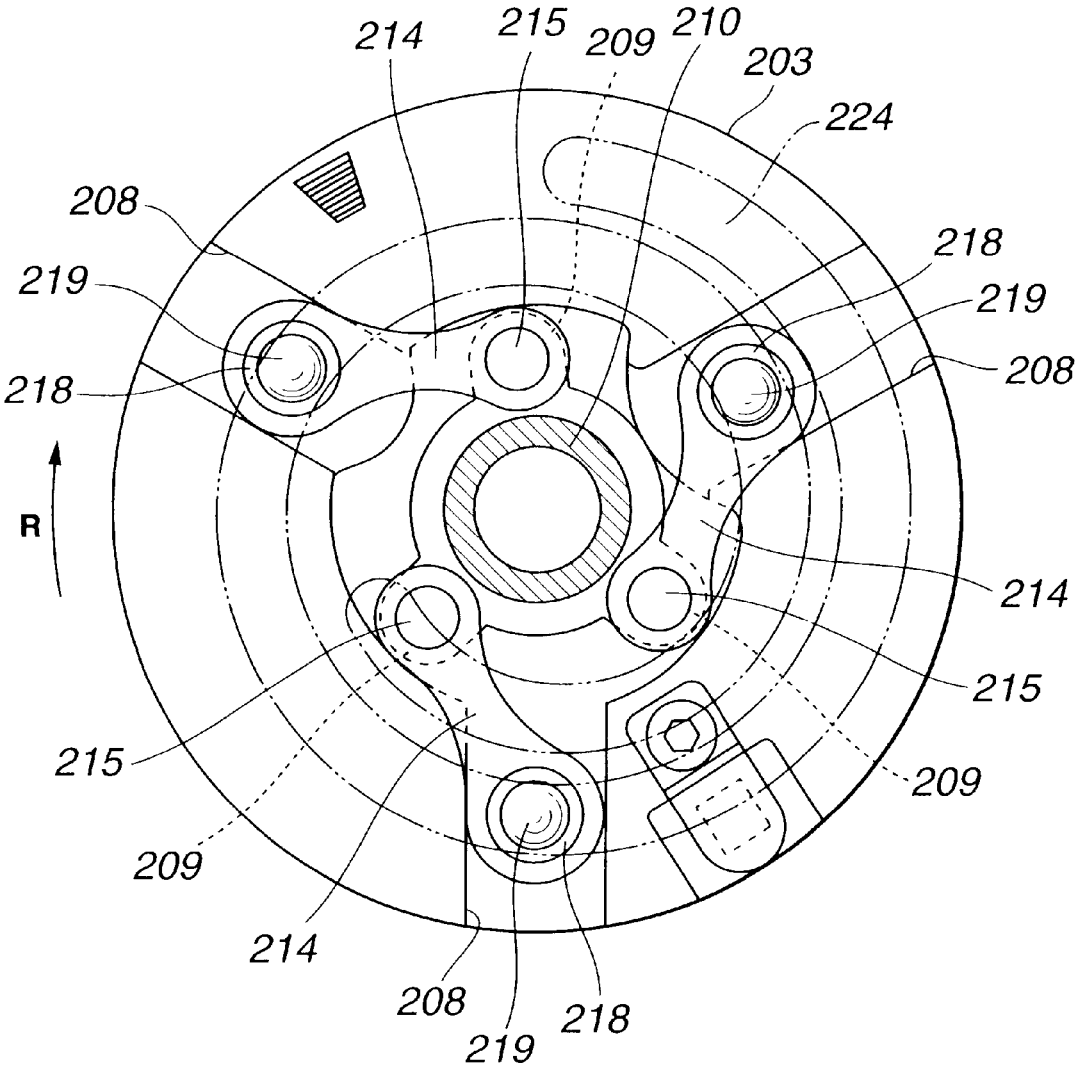
FIG. 14 is a view similar to FIG. 13, explaining operation of the third embodiment.
Figure 15:
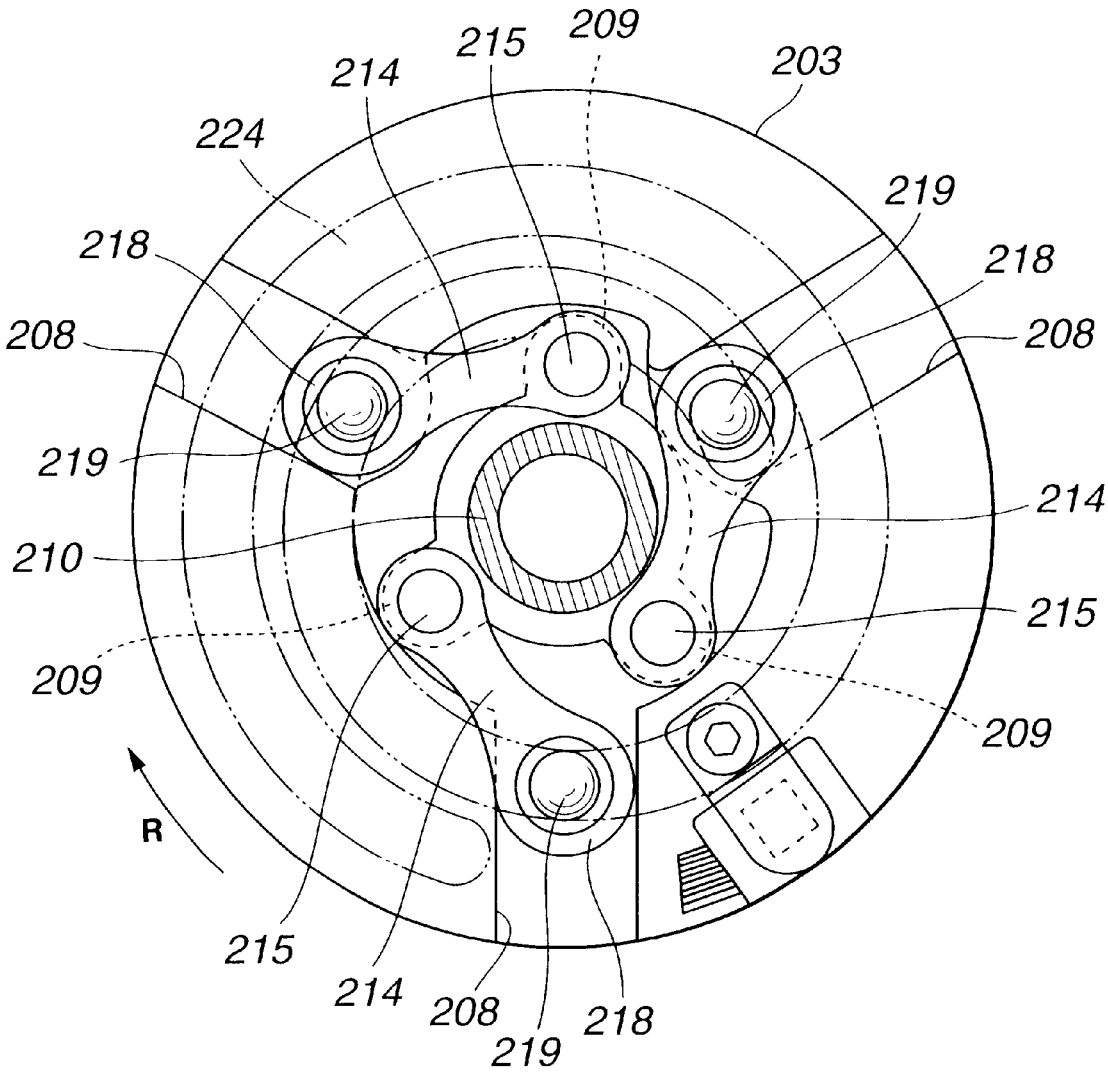
FIG. 15 is a view similar to FIG. 14, explaining operation of the third embodiment.

A roughly disc-like intermediate rotator 223 is rotatably supported to lever shaft 210 in front of the protruding position of lever 209. Spiral slot 224 with semicircular section is formed in the rear face of intermediate rotator 223, and ball 219 of link 214 is engaged therewith in a free rolling way. Referring to FIGS. 11 and 14–15, a spiral of spiral slot 224 is gradually reduced in diameter along a direction of rotation R of driving plate 203. Therefore, with ball 219 of link 214 engaged with spiral slot 224, when intermediate rotator 223 performs relative rotation in the lag direction with respect to driving plate 203, the head of link 214 is moved radially inward along the spiral of spiral slot 224, whereas when intermediate rotator 223 performs relative rotation in the advance direction, the head of link 214 is moved radially outward.

Mounting-angle control mechanism 205 comprises radial slot 208 of driving plate 203, protrusion 217, ball 219, link 214, lever 209, spiral slot 224 of intermediate rotator 223, etc. When operating-force providing means 204 provide to intermediate rotator 223 an operating force for rotation with respect to camshaft 201, mounting-angle control mechanism 205 radially displaces the head of link 214 through the engagement of spiral slot 224 and ball 219, transferring relative torque to driving plate 203 and camshaft 201 under the action of link 214 and lever 209.

Operating-force providing means 204 comprise a pair of electromagnetic brakes 226, 227 and a planetary-gear set 228, and can selectively appropriately provide a force in the speed reducing direction and a force in the speed increasing direction by switching of operation of electromagnetic brakes 226, 227.

Figure 12:
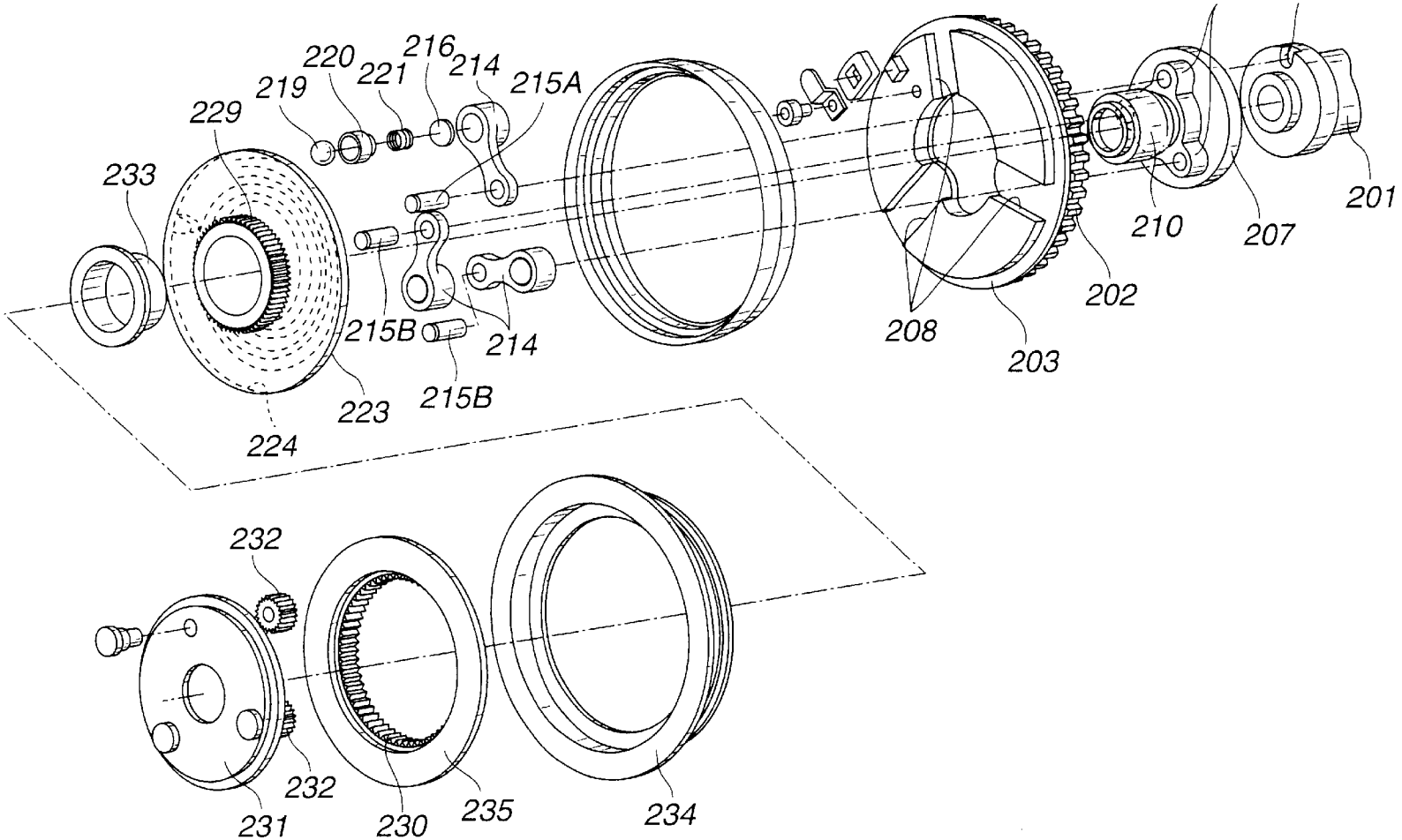
FIG. 12 is a view similar to FIG. 9, showing the third embodiment of present invention.
Figure 13:
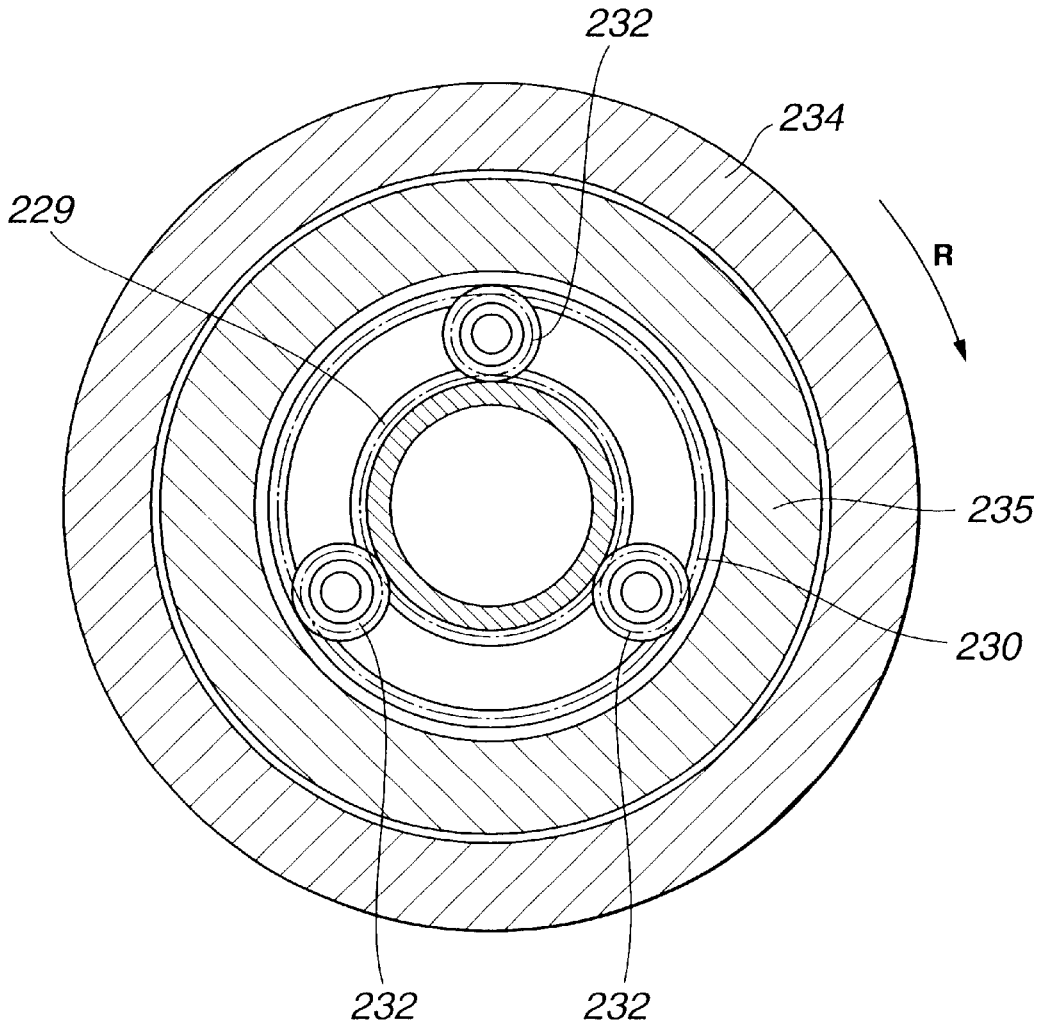
FIG. 13 is a view similar to FIG. 11, taken along the line XIII—XIII in FIG. 10.

Referring to FIGS. 10 and 12–13, planetary-gear set 228 comprises a sun gear 229 integrally formed with the inner peripheral edge of intermediate rotator 223 to protrude axially forward, an outer gear 230 rotatably disposed at the outer periphery of sun gear 229, a disc-like carrier plate 231 press fit in the head of lever shaft 210, and a plurality of planetary gears 232 rotatably supported by carrier plate 231 and meshed with sun gear 229 and outer gear 230. A bush 233 with roughly L-shaped section is press fit in the inner periphery of sun gear 229, through which intermediate rotator 223 is rotatably supported on the outer periphery of the head of lever shaft 210.

With planetary-gear set 228, therefore, when outer gear 230 is in free rotation, and planetary gears 232 does not rotate but revolves with carrier plate 231, outer gear 230 and sun gear 229 rotate together at the same speed as carrier plate 231 or lever shaft 210. In this state, when a braking force is provided to outer gear 230 only, outer gear 230 performs relative rotation in the lag direction with respect to carrier plate 231 to make rotation of planetary gears 232, increasing the speed of sun gear 229, making relative rotation of intermediate rotator 223 in the speed increasing direction with respect to driving plate 203.

Electromagnetic brakes 226, 227 are formed like roughly annularly as a whole, first brake 226 being disposed radially inward of second brake 227. First electromagnetic brake 226 disposed outside and second electromagnetic brake 227 disposed inside have substantially the same constitution except that first electromagnetic brake 226 faces the front end face of a first braking flange 234 integrally mounted to the outer peripheral edge of intermediate rotator 223, whereas second electromagnetic brake 227 faces the front end face of a second braking flange 235 extending from the front end of outer gear 230.

Electromagnetic brakes 226, 227 are fixed to the inner surface of VTC cover 212, and provide a braking force to braking flanges 234, 235 by operating a magnetic attraction therebetween.

In this embodiment, as shown in FIGS. 10 and 12, pivot pins 215A, 215B for coupling links 214 to levers 209 are constructed such that pivot pin 215A, which is axially longer than pivot pin 215B, is arranged through large-diameter flange 207 of lever haft 210 for engagement with a recess 242 of camshaft 201.

As shown in FIG. 10, a supply passage 240 is formed to extend from the perimeter of the bolt engagement of camshaft 201 and lever shaft 210 to the end face of lever shaft 210 and the back face of carrier plate 231.

Next, operation of the third embodiment is described.

Upon engine start and during idle running, energization of first electromagnetic brake 226 is turned off, and energization of second electromagnetic brake 227 is turned on, providing a braking force to second braking flange 235 only. With this, the braking force acts on outer gear 230 of planetary-gear set 228 to rotate intermediate rotator 223 in the speed increasing direction in accordance with rotation of driving plate 203, maintaining the head of link 114 at the radially outside end as shown in FIG. 11. Therefore, the mounting angle of lever shaft 210 or camshaft 201 pivotally connected to link 114 through lever 209 is maintained at the maximum lag-angle side with respect to driving plate 203. As a result, the phase of rotation of the crankshaft and camshaft 201 is controlled to the maximum lag angle, achieving stabilized engine rotation and enhanced fuel consumption.

From this state, when the engine proceeds to normal running, first electromagnetic brake 226 is turned on, and second electromagnetic brake 227 is turned off, providing a braking force to first braking flange 234 only. With this, outer gear 230 is in free rotation, whereas the braking force acts on intermediate rotator 223, which is rotated in the speed reducing direction with respect to driving plate 203. As a result, ball 219 at the head of link 214 is guided by spiral slot 224 to the center of the spiral thereof as shown in FIGS. 14–15, and protrusion 217 is displaced radially inward along radial slot 208 while rotating therein. Lowering of link 214 due to that displacement changes the mounting angle of driving plate 213 and lever shaft 210 to the maximum advance-angle side. This leads to a power increase of the engine.

In this embodiment, cylindrical protrusion 217 integrally formed with link 214 at the head thereof is rotated in radial slot 208 to allow swing of the head of link 214, resulting in no need of separately arranging a pivot pin for rotating the head of link 214 No arrangement of a support structure such as a pivot pin allows a reduction in size and weight of the head of link 214.

Therefore, the head of link 214 is less prone to interfere with other peripheral parts, providing a fully large swinging angle of link 214, allowing setting of a great operating amount of the mounting angle of driving plate 203 and lever shaft 210. Moreover, due to its small mass, the head of link 214 is less prone to being affected by a centrifugal force during high-speed operation and the like, allowing always stable valve timing control regardless of engine operating conditions.

Moreover, in this embodiment, as being formed cylindrically, protrusion 217 at the head of link 214 comes contact with the side walls of radial slot 208 always with a sufficiently large axial width. This reduces the contact surface pressure between protrusion 217 and radial slot 208, leading to less occurrence of wear and the like at protrusion 217 and radial slot 208 even after a longtime use.

Further, in this embodiment, through hole 218 is formed to extend from the main body of link 214 to protrusion 217, and plate sealing member 216 is press fit therein at the end on the side of protrusion 217. Thus, control of the thickness of sealing member 216 allows easy setting and adjusting of an initial load of coil spring 221 and a backward stroke of ball 219.

The present invention can be carried out in other specific forms. By way of example, a protrusion with circular section may be integrated with link 214 at the head thereof to extend to spiral guide 224 for engagement therewith. In this variation, protrusion 217 engaged with radial slot 208 is formed, preferably, with the head of link 214 as in the third embodiment. Optionally, a separate and distinct engaging member may be arranged without forming protrusion 217.

Figure 16:
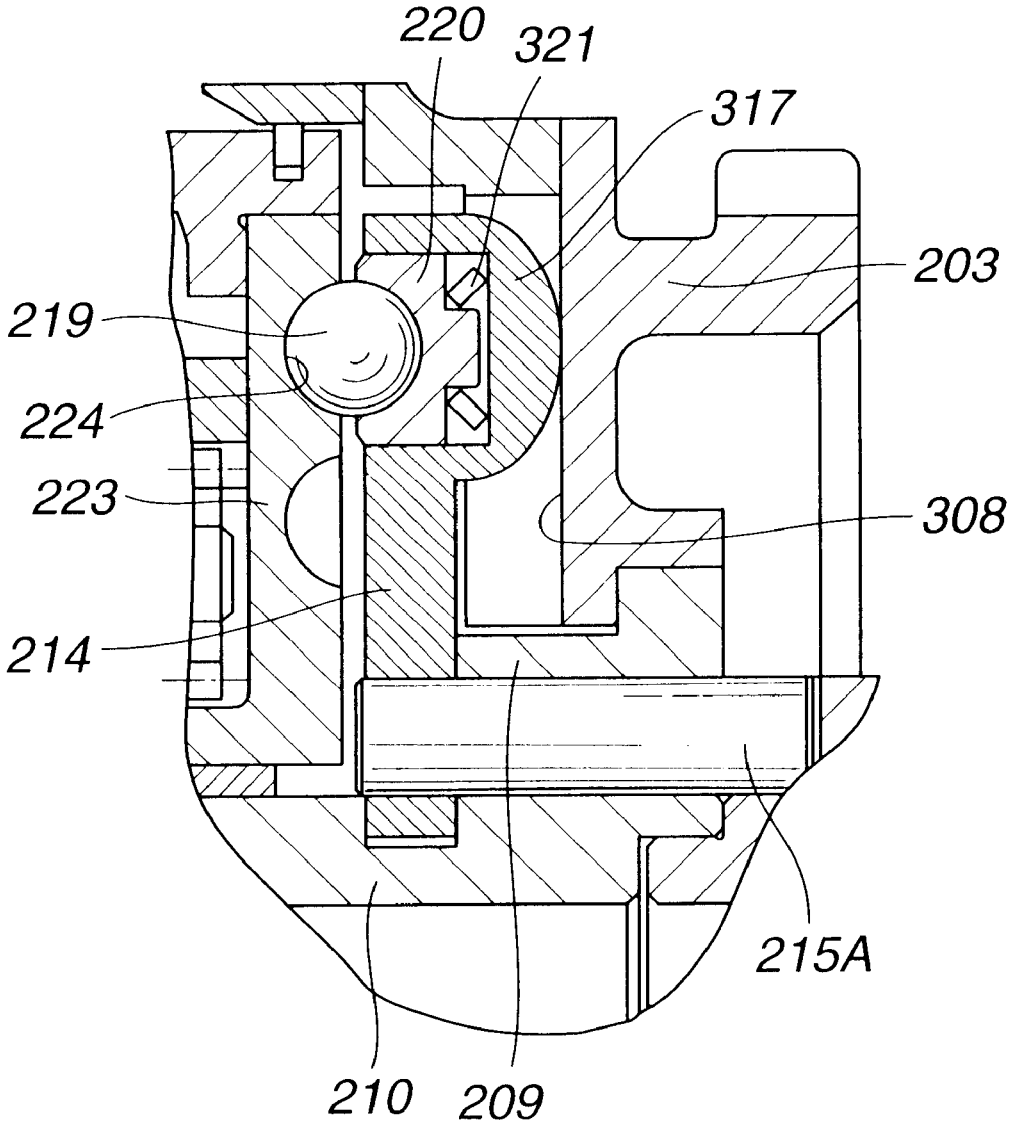
FIG. 16 is an enlarged sectional view showing fourth embodiment of the present invention.

In the third embodiment, protrusion 217 at the head of link 214 is formed cylindrically. Optionally, referring to FIG. 16, a protrusion 317 may be formed spherically with a radial slot 308 of driving plate 203 having a circular section with larger radius of curvature than protrusion 317. In this variation, the contact resistance between protrusion 317 and radial slot 308 is reduced, thus allowing smooth operation of link 214. Moreover, even upon abrupt load input and the like, protrusion 317 does not collide with the wall face of radial slot 308 at an angle close to the right angle, allowing sure prevention of backlash therebetween. In place of a coil spring, biasing member 221 may be a disc spring 321 as shown in FIG. 16, a rubber elastic body or the like.

According to the present invention, the protrusion with circular section integrated with the head of the link is directly slid and rotated in the radial guide or the spiral guide without recourse to a separate and distinct part at the head of the link, leading to a reduction in the number of parts, size, and weight of the head of the link. This allows a reduction in manufacturing cost of the overall system, an increase in design flexibility of various system portions due to size reduction of the link head, and a stabilization of valve timing control due to reduced inertial mass of the link head.

Having described the present invention with regard to the preferred embodiment, it is noted that the present invention is not limited thereto, and various changes and modifications can be made without departing from the scope of the present invention.

The entire contents of Japanese Patent Application P2001-243052 filed Aug. 10, 2001 and Japanese Patent Application P2001-315063 filed Oct. 12, 2001 are incorporated hereby by reference.

What is claimed is:

1. A system for controlling a valve timing in an internal combustion engine, comprising:

a driving rotator rotated by a crankshaft of the engine;

a follower rotator provided to a camshaft of the engine, the follower rotator receiving power from the driving rotator;

a radial guide provided to one of the driving rotator and the follower rotator;

an intermediate rotator arranged rotatable with respect to the driving rotator and the follower rotator, the intermediate rotator comprising a spiral guide in a face opposite to the radial guide;

a movable member guided by the radial guide and the spiral guide;

a link which swingably couples another of the driving rotator and the follower rotator at a position distant from a center of rotation thereof to the movable member;

a device which provides to the intermediate rotator an operating force for rotation with respect to the driving rotator and the follower rotator, the device making radial displacement of the movable member, the radial displacement being converted into relative rotation of the driving rotator and the follower rotator through the link; and a protrusion integrally formed with the link at an end thereof, the protrusion extending axially and having a circular section, the protrusion constituting part of the movable member, the protrusion being slidably engaged with one of the radial guide and the spiral guide.

2. The system as claimed in claim 1, wherein the protrusion is formed cylindrically.

3. The system as claimed in claim 1, wherein the protrusion extends to the radial guide, the link and the protrusion being formed with a through hole.

4. The system as claimed in claim 2, further comprising in the through hole a sealing member arranged at an end on the side of the protrusion, a ball engaged with the spiral guide, a retainer for supporting the ball, and a biasing member interposed between the sealing member and the retainer for biasing the ball toward the spiral guide.

5. The system as claimed in claim 1, wherein the protrusion has a front end formed spherically, the one of the radial guide and the spiral guide having a section with larger radius of curvature than that of the front end of the protrusion.

6. A system for controlling a valve timing in an internal combustion engine, comprising:

a driving rotator rotated by a crankshaft of the engine;

a follower rotator provided to a camshaft of the engine, the follower rotator receiving power from the driving rotator;

a radial guide provided to one of the driving rotator and the follower rotator;

an intermediate rotator arranged rotatable with respect to the driving rotator and the follower rotator, the intermediate rotator comprising a spiral guide in a face opposite to the radial guide;

a movable member guided by the radial guide and the spiral guide;

a link which swingably couples another of the driving rotator and the follower rotator at a position distant from a center of rotation thereof to the movable member;

means for providing to the intermediate rotator an operating force for rotation with respect to the driving rotator and the follower rotator, the providing means making radial displacement of the movable member, the radial displacement being converted into relative rotation of the driving rotator and the follower rotator through the link; and a protrusion integrally formed with the link at an end thereof, the protrusion extending axially and having a circular section, the protrusion constituting part of the movable member, the protrusion being slidably engaged with one of the radial guide and the spiral guide.

7. The system as claimed in claim 8, wherein the link has a base end and a front end, the base end being coupled to another of the driving rotator and the follower rotator, the front end comprising a first engagement engaged with the spiral guide and a second engagement engaged with the radial guide.

8. The system as claimed in claim 7, wherein the first engagement comprises a ball.

9. The system as claimed in claim 7, wherein the second engagement comprises a block member extending from the front end of the link to the radial guide.

10. The system as claimed in claim 8, wherein the ball of the first engagement is arranged in the block member.

11. The system as claimed in claim 1, further comprising a biasing member which biases at least one of the first engagement and the second engagement toward a counter-member.

* * * * *